US010798500B1

(12) United States Patent
Shi et al.

(10) Patent No.: US 10,798,500 B1
(45) Date of Patent: Oct. 6, 2020

(54) BEHIND-THE-EAR HEARING AID

(71) Applicant: XIAMEN RETONE HEARING TECHNOLOGY CO., LTD., Xiamen, Fujian (CN)

(72) Inventors: Yiquan Shi, Xiamen (CN); Chengxiang Zhang, Xiamen (CN)

(73) Assignee: XIAMEN RETONE HEARING TECHNOLOGY CO., LTD., Xiamen, Fujian (CN)

( * ) Notice: Subject to any disclaimer, the term of this patent is extended or adjusted under 35 U.S.C. 154(b) by 0 days.

(21) Appl. No.: 16/425,947

(22) Filed: May 30, 2019

(51) Int. Cl.
*H04R 25/00* (2006.01)

(52) U.S. Cl.
CPC ..... *H04R 25/602* (2013.01); *H04R 2225/021* (2013.01)

(58) Field of Classification Search
CPC ..... H04R 25/602; H04R 2225/021
USPC ..... 381/323
See application file for complete search history.

(56) References Cited

U.S. PATENT DOCUMENTS

2003/0156727 A1* 8/2003 Vonlanthen ..... H04R 25/556 381/330
2008/0118093 A1* 5/2008 Klemenz ..... H04R 25/55 381/324
2013/0058512 A1* 3/2013 Schumaier ..... H04R 25/65 381/314
2014/0334651 A1* 11/2014 Higgins ..... H04R 25/602 381/323
2016/0227333 A1* 8/2016 Babico ..... H04R 25/65
2017/0195804 A1* 7/2017 Sandhu ..... H02J 7/0042

* cited by examiner

*Primary Examiner* — Sean H Nguyen
(74) *Attorney, Agent, or Firm* — Leong C. Lei

(57) ABSTRACT

A behind-the-ear hearing aid includes a case having an accommodating chamber, an apparatus for processing sounds, an ear hook, and a battery assembly. The apparatus is mounted in the case. The battery assembly is detachably mounted in the accommodating chamber and electrically connected to the apparatus. When the power of the battery assembly is used up, the hearing aid can be continuously used by disassembling and replacing a new battery assembly, thereby solving the problem that the battery assembly in the existing hearing aid cannot be dissembled and replaced. It is environmentally friendly and convenient for use.

8 Claims, 4 Drawing Sheets

BEHIND-THE-EAR HEARING AID

BACKGROUND OF THE INVENTION

1. Field of the Invention

The present invention relates to a hearing aid, and more particularly to a behind-the-ear hearing aid.

2. Description of the Prior Art

Hearing aids are used for a variety of pathologies including sensorineural hearing loss, conductive hearing loss, and single-sided deafness. A hearing aid is a device designed to improve hearing by making sound audible to a person with hearing loss. For a person with hearing loss, a hearing aid is an indispensable aid in his/her life, so it is very important.

The existing hearing aids can be classified into an invisible-in-canal hearing aid, a behind-the-ear hearing aid, in-the-canal hearing aid, a completely-in-canal hearing aid. The behind-the-ear hearing aid is worn on the back of the ear when in use. Considering the comfort of the wearer and the influence on the appearance of the user, the behind-the-ear hearing aid is generally composed of small components to suit the shape of the human ear. Due to the small size of the structure, the components are usually fixedly mounted together during assembly, including a battery assembly that supplies power to the behind-the-ear hearing aid.

For the user, the fixed the battery assembly cannot be replaced when the battery is used up, which is neither environmentally friendly nor inconvenient for use. Especially for those who do outdoor activities for a long time, such as those who are engaged in field exploration, because of the fixed battery assembly, they have to purchase and carry more hearing aids. This is very inconvenient for use.

Accordingly, the inventor of the present invention has devoted himself based on his many years of practical experiences to solve these problems.

SUMMARY OF THE INVENTION

The primary object of the present invention is to provide a behind-the-ear hearing aid. The battery assembly of the hearing aid of the invention can be disassembled and replaced, which is environmentally friendly and convenient for use.

In order to achieve the above object, the present invention adopts the following technical solutions:

A behind-the-ear hearing aid comprises a case, an apparatus for processing sounds, an ear hook, and a battery assembly. The apparatus is mounted in the case. One end of the ear hook is connected to the apparatus for transmitting the sounds after being processed by the apparatus. The case is provided with an accommodating chamber. The battery assembly is detachably mounted in the accommodating chamber and electrically connected to the apparatus.

Preferably, the battery assembly includes a battery holder having a battery compartment and a rechargeable battery. The battery holder is detachably mounted in the accommodating chamber. The rechargeable battery is embedded in the battery compartment and electrically connected to the apparatus.

Preferably, the battery assembly further includes two pogo pins, namely, a positive pogo pin and a negative pogo pin, and a negative connecting plate; the battery holder is provided with two mounting holes and a mounting slot. One of the mounting holes is in communication with the mounting slot, and the other mounting hole is in communication with the battery compartment. One end of the negative connecting plate is detachably mounted in the mounting slot, and another end of the negative connecting plate is moveably in contact with a negative terminal of the rechargeable battery. The positive pogo pin is mounted in the mounting hole communicating with the battery compartment and is moveably in contact with a positive terminal of the rechargeable battery. The negative pogo pin is mounted in the mounting hole communicating with the mounting slot and is electrically connected to the negative connecting plat.

Preferably, the negative connecting plate is an elastic plate. The negative connecting plate is provided with a bent portion. The bent portion of the negative connecting plate is movably engaged in the mounting slot.

Preferably, the battery holder is provided with a cover plate. An outer end of the accommodating chamber is provided with a recessed platform. The cover plate is fitted in the recessed platform. One side of the recessed platform is provided with a recess. The cover plate is provided with a protrusion extending into the recess. A gap is defined between the protrusion and the recess.

Preferably, the battery assembly further includes a first magnetic member. The hearing aid further includes a charging device provided with a second magnetic member. The first magnetic member is fixedly mounted on the battery holder. The second magnetic member is fixedly mounted on the charging device. The first magnetic member is magnetically coupled to the second magnetic member.

Preferably, the case includes an upper case and a lower case. The upper case is detachably mounted to the lower case.

Preferably, the behind-the-ear hearing aid further comprises a pin. The apparatus includes a lining member. The upper case, the lower case and the lining member are provided with a first pin hole, a second pin hole and a third pin hole, respectively. The pin is inserted into the first pin hole, the second pin hole and the third pin hole for connecting the upper case, the lower case and the lining member.

Preferably, the battery holder is provided with a fourth pin hole. The pin is further inserted into the fourth pin hole for connecting the upper case, the lower case, the lining member and the battery holder.

Preferably, the upper case is provided with a positioning block. The lower case is provided with a positioning notch. The positioning block is fitted in the positioning notch.

After adopting the above solution, the battery assembly of the present invention is detachably mounted in the accommodating chamber. When the power of the battery assembly is used up, the hearing aid can be continuously used by disassembling and replacing a new battery assembly, thereby solving the problem that the battery assembly in the existing hearing aid cannot be dissembled and replaced. The battery assembly of the present invention is environmentally friendly and convenient for use.

Besides, in the present invention, the upper case, the lower case and the lining member are connected together through the pin. Compared with a screw or a buckle structure, the pin is easily processed into a small structure to fit the hearing aid. The production of the pin is simple and low in cost, so that the hearing aid of the present invention has the advantages of simple production and low cost. In the present invention, the pin is configured to connect the upper case, the lower case and the lining member to provide a limiting and fixing function for the connection of the three, so that the structure of the hearing aid of the invention is more firm and stable.

Besides, in the present invention, the battery assembly is provided with the pogo pins. When the power of the rechargeable battery is used up, the rechargeable battery can be charged by the charging device through the pogo pins. It is not necessary to disassemble the rechargeable battery, thereby making the hearing aid of the present invention more convenient for use.

DETAILED DESCRIPTION OF THE PREFERRED EMBODIMENTS

Embodiments of the present invention will now be described, by way of example only, with reference to the accompanying drawings.

Figure 1:
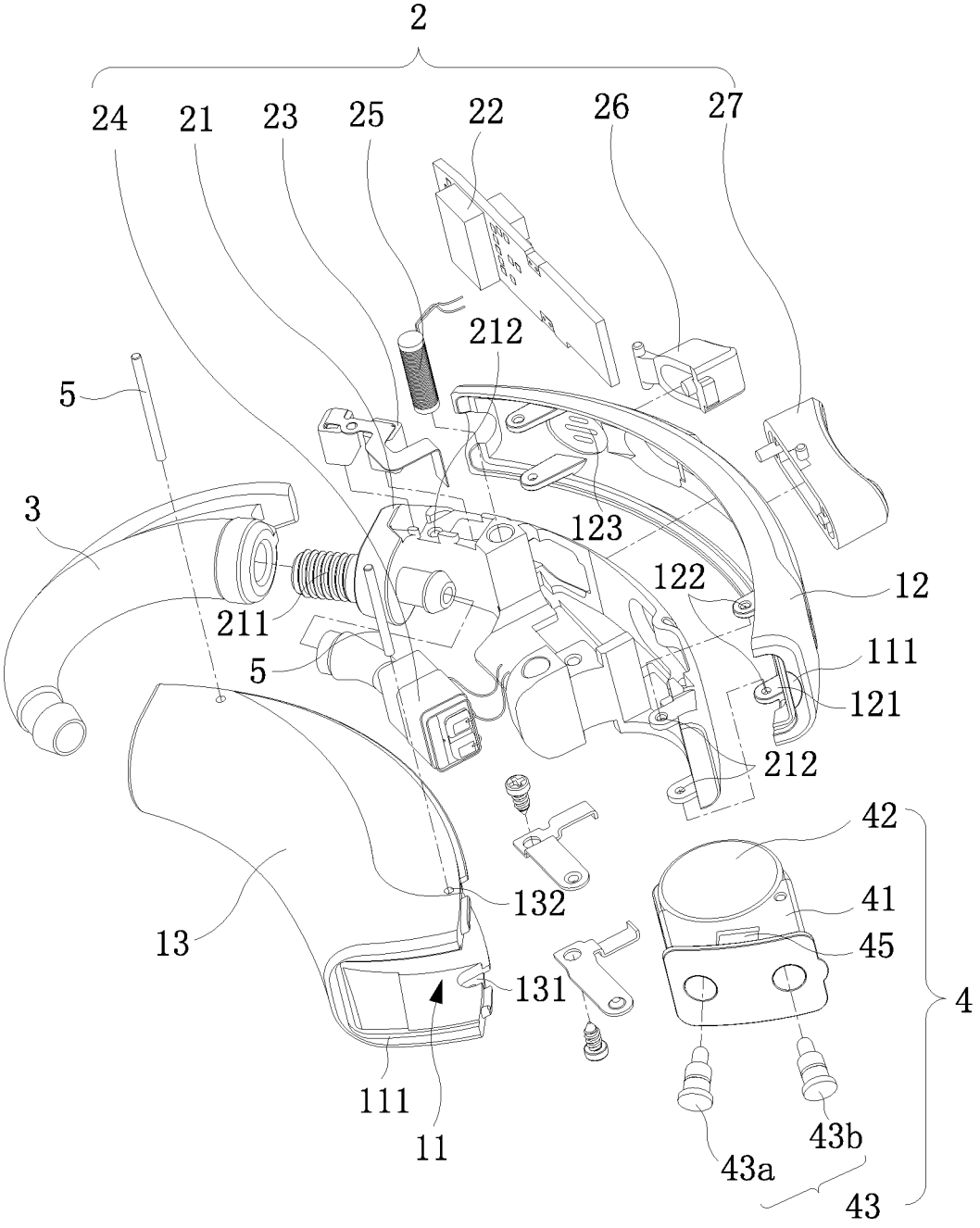
FIG. 1 is an exploded view of a preferred embodiment of the present invention.
Figure 2:
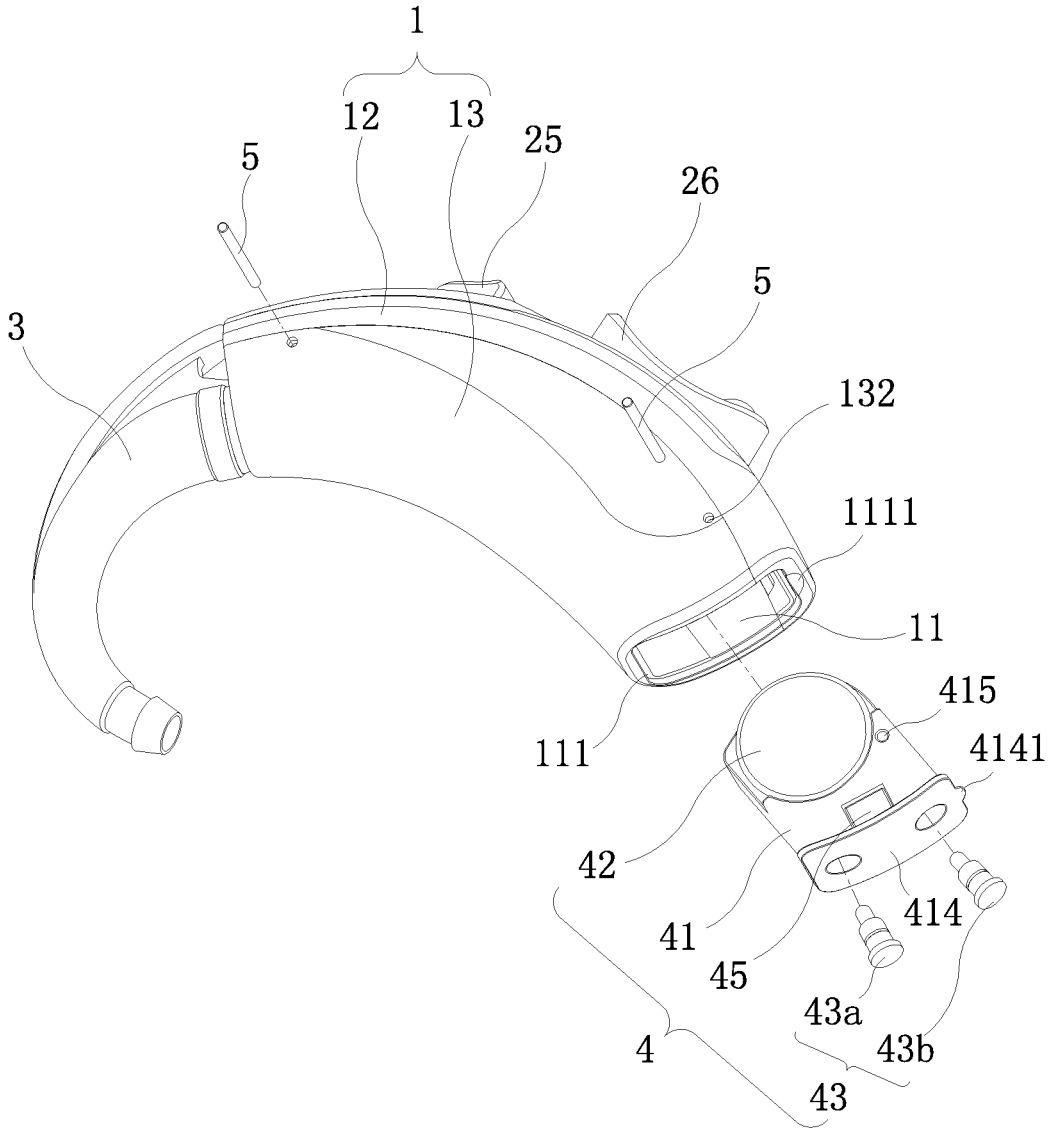
FIG. 2 is a schematic view of the preferred embodiment of the present invention, showing that the battery assembly is removed.
Figure 3:
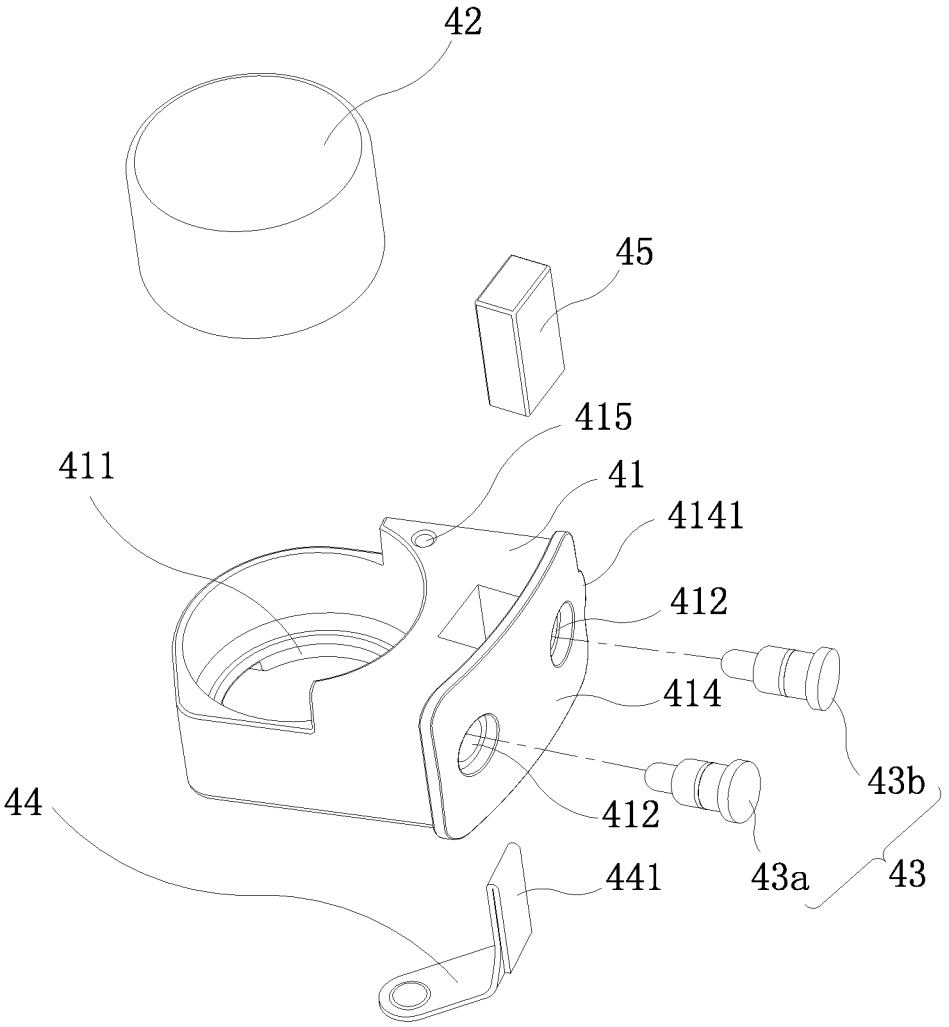
FIG. 3 is an exploded view of the battery assembly of the preferred embodiment of the present invention.
Figure 4A:
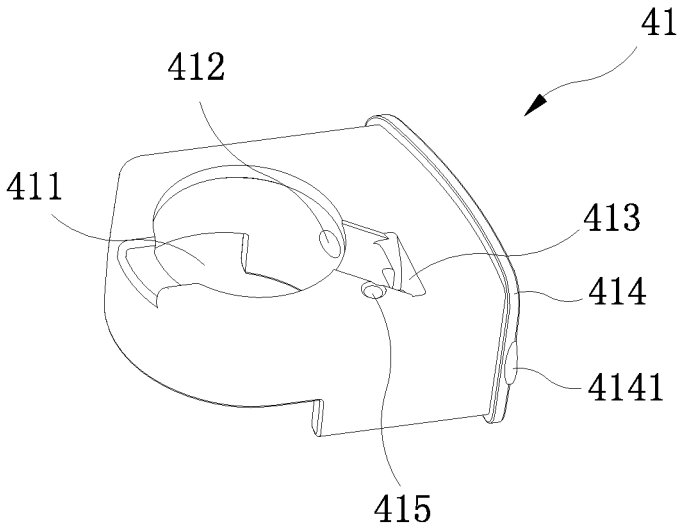
FIG. 4*a* is a first schematic view of the battery holder of the preferred embodiment of the present invention.
Figure 4B:
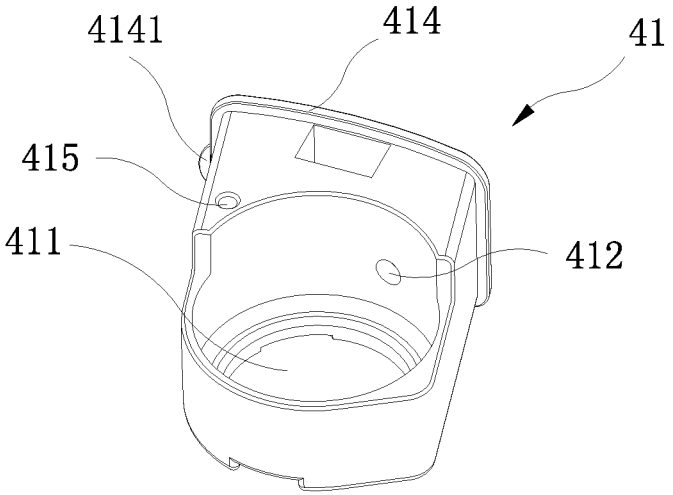
FIG. 4*b* is a second schematic view of the battery holder of the preferred embodiment of the present invention.

As shown in FIG. 1 through FIG. 4, a behind-the-ear (BTE) hearing aid according to a preferred embodiment of the present invention comprises a case 1, an apparatus 2 for processing sounds, an ear hook 3, and a battery assembly 4. The apparatus 2 is mounted in the case 1. One end of the ear hook 3 is connected to the apparatus 2 for transmitting the sounds after being processed by the apparatus 2. The case 1 is provided with an accommodating chamber 11. The battery assembly 4 is detachably mounted in the accommodating chamber 11 and electrically connected to the apparatus 2.

In the present invention, the battery assembly 4 is detachably mounted in the accommodating chamber 11. When the power of the battery assembly 4 is used up, the hearing aid can be continuously used by disassembling and replacing a new battery assembly 4, thereby solving the problem that the battery assembly 4 in the existing hearing aid cannot be dissembled and replaced. The battery assembly 4 of the present invention is environmentally friendly and convenient for use.

The battery assembly 4 includes a battery holder 41 having a battery compartment 411 and a rechargeable battery 42. The battery holder 41 is detachably mounted in the accommodating chamber 11. The rechargeable battery 42 is embedded in the battery compartment 411 and electrically connected to the apparatus 2. The battery assembly 4 of the present invention is provided with the rechargeable battery 42. When the power of the rechargeable battery 42 is used up, the rechargeable battery 42 can be re-used by charging it, thereby making the hearing aid of the present invention more environmentally friendly.

The battery assembly 4 further includes two pogo pins 43, namely, a positive pogo pin 43*a* and a negative pogo pin 43*b*, and a negative connecting plate 44. The battery holder 41 is provided with two mounting holes 412 and a mounting slot 413. One of the mounting holes 412 is in communication with the mounting slot 413, and the other mounting hole 412 is in communication with the battery compartment 411. One end of the negative connecting plate 44 is detachably mounted in the mounting slot 413, and another end of the negative connecting plate 44 is moveably in contact with the negative terminal of the rechargeable battery 42. The positive pogo pin 43*a* is mounted in the mounting hole 412 communicating with the battery compartment 411, and is moveably in contact with the positive terminal of the rechargeable battery 42. The negative pogo pin 43*b* is mounted in the mounting hole 412 communicating with the mounting slot 413, and is electrically connected to the negative connecting plat 44. In the present invention, the battery assembly 4 is provided with the pogo pins 43. When the power of the rechargeable battery 42 is used up, the rechargeable battery 42 can be charged by a charging device through the pogo pins 43. It is not necessary to disassemble the rechargeable battery 42, thereby making the hearing aid of the present invention more convenient for use.

The negative connecting plate 44 is an elastic plate. The negative connecting plate 44 is provided with a bent portion 441. The bent portion 441 of the negative connecting plate 44 is movably engaged in the mounting slot 413. Because the negative connecting plate 44 is an elastic plate, when installed, only the bent portion 441 is to be bent, and then the bent portion 441 is engaged into the mounting slot 413 to complete the installation of the negative connecting plate 44. The negative connecting plate 44 of the present invention has the advantage of simple installation, without the need for screws or other mounting parts.

The battery holder 41 is provided with a cover plate 414. The outer end of the accommodating chamber 11 is provided with a recessed platform 111. The cover plate 414 is fitted in the recessed platform 111. When installed, the battery holder 41 is inserted in the accommodating chamber 11 of the case 1 until the cover plate 414 abuts against the recessed platform 111. At this time, the rechargeable battery 42 is electrically connected to the apparatus 2 as the battery holder 41 is inserted in the accommodating chamber 11. Therefore, by providing the cover plate 414 and the recessed platform 111, the battery holder 41 can be installed and positioned accurately.

One side of the recessed platform 111 is provided with a recess 1111. The cover plate 414 is provided with a protrusion 4141 extending into the recess 1111. A gap is defined between the protrusion 4141 and the recess 1111. When the battery assembly 4 needs to be removed, the user inserts his/her fingernail (or other tools) into the gap between the protrusion 4141 and the recess 1111. The battery assembly 4 is pulled out from the accommodating chamber 11 by pulling the protrusion 4141. Therefore, the disassembly of the battery assembly 4 is facilitated by providing the recess 1111 and the protrusion 4141.

The battery assembly 4 further includes a first magnetic member 45. The hearing aid further includes a charging device (not shown) provided with a second magnetic member (not shown). The first magnetic member 45 is fixedly mounted on the battery holder 41. The second magnetic member is fixedly mounted on the charging device. The first magnetic member 45 is magnetically coupled to the second magnetic member. In this embodiment, both the first magnetic member 45 and the second magnetic member are magnets. When the rechargeable battery 42 is charged by the charging device through the pogo pins 43, the hearing aid is placed on the charging device and electrically connected to the charging device. At this time, the magnet on the battery assembly 4 and the magnet on the charging device form a magnetic fixation of N and S poles, thereby fixing the hearing aid to the charging device and preventing the hearing aid from shaking during charging to result in poor contact and affect normal charging.

The apparatus 2 includes a lining member 21 provided with a sound guiding tube 211, a PCBA board 22, a microphone 23, a receiver 24, and an inductor 25. The lining member 21 is installed in the case 1. One end of the sound guiding tube 211 extends out of the case 1 and is connected to the ear hook 3. Another end of the sound guiding tube 211 is connected to the receiver 24. The PCBA board 22, the microphone 23, the receiver 24 and the inductor 25 are all mounted on the lining member 21. The PCBA board 22 is electrically connected to the microphone 23, the receiver 24, and the inductor 25, respectively. In use, the microphone 23 collects the surrounding sounds and converts a sound signal into an electrical signal to the PCBA board 22. The PCBA board 22 is capable of processing the electrical signal to change the quality and volume of the sound. The electrical signal after processed is transmitted from the PCBA board 22 to the receiver 24. The receiver 24 converts the electrical signal into a sound signal to be transmitted to the user through the sound guiding tube 211 and the ear hook 3.

The apparatus 2 further includes a program button 26 and a volume button 27. The program button 26 and the volume button 27 are movably mounted on the side wall of the case 1. The program button 26 and the volume button 27 each have one end extending to the outside of the case 1 for the user to operate and another end connected to the PCBA board 22 for switching the sound quality mode and the volume of the hearing aid, respectively. The hearing aid may be used in different environments, such as a quiet place like a library and a noisy place like a station. The user can switch the sound quality of the hearing aid through the program button 26, or adjust the volume of the hearing aid through the volume button 27 to suit the environment in which the user is located.

The case 1 includes an upper case 12 and a lower case 13. The upper case 12 is detachably mounted to the lower case 13. When installed, the apparatus 2 is first mounted to the upper case 12, and then the lower case 13 is mounted to the upper case 12, thereby mounting the apparatus 2 in the case 1. The case 1 is divided into the upper case 12 and the lower case 13, which is beneficial for the mounting operation of the hearing aid.

The upper case 12 is provided with a positioning block 121. The lower case 13 is provided with a positioning notch 131. The positioning block 121 is fitted in the positioning notch 131. The positioning block 121 and the positioning notch 131 provide a positioning function for the upper case 12 and the lower case 13.

The hearing aid further includes a pin 5. The upper case 12, the lower case 13, and the lining member 21 are provided with a first pin hole 122, a second pin hole 132 and a third pin hole 212, respectively. The pin 5 is inserted into the first pin hole 122, the second pin hole 132 and the third pin hole 212 for connecting the upper case 12, the lower case 13 and the lining member 21. The hearing aid is small in order to fit the shape of the human ear. In the present invention, the upper case 12, the lower case 13 and the lining member 21 are connected together through the pin 5. Compared with a screw or a buckle structure, the pin 5 is easily processed into a small structure to fit the hearing aid. The production of the pin 5 is simple and low in cost, so that the hearing aid of the present invention has the advantages of simple production and low cost. In the present invention, the pin 5 is configured to connect the upper case 12, the lower case 13 and the lining member 21 to provide a limiting and fixing function for the connection of the three, so that the structure of the hearing aid of the invention is more firm and stable.

The battery holder 41 is provided with a fourth pin hole 415. The pin 5 is also inserted into the fourth pin hole 415 for connecting the upper case 12, the lower case 13, the lining member 21 and the battery holder 41. In the present invention, the pin 5 is configured to connect the upper case 12, the lower case 13, the lining member 21 and the battery holder 41 to provide a limiting and fixing function for the connection of the fourth, so that the structure of the hearing aid of the invention is more firm and stable. When it is necessary to remove the battery assembly 4, the user needs to remove the pin 5 first, and then insert his/her fingernail (or other tools) into the gap between the protrusion 4141 and the recess 1111, such that the battery assembly 4 can be pulled out from the accommodating chamber 11 by pulling the protrusion 4141.

The upper case 12 is provided with a plurality of slots 123. The microphone 23 mounted on the lining member 21 is disposed close to the slots 123. The slots 123 are advantageous for the microphone 23 to collect the surrounding sounds.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A behind-the-ear hearing aid, comprising a case, an apparatus for processing sounds, an ear hook, and a battery assembly; the apparatus being mounted in the case; one end of the ear hook being connected to the apparatus for transmitting the sounds after being processed by the apparatus; the case being provided with an accommodating chamber, the battery assembly being detachably mounted in the accommodating chamber and electrically connected to the apparatus, wherein the battery assembly includes a battery holder having a battery compartment and a rechargeable battery, the battery holder is detachably mounted in the accommodating chamber, and the rechargeable battery is embedded in the battery compartment and electrically connected to the apparatus, and wherein the battery assembly further includes two pogo pins, namely, a positive pogo pin and a negative pogo pin, and a negative connecting plate, the battery holder is provided with two mounting holes and a mounting slot, one of the mounting holes is in communication with the mounting slot, the other mounting hole is in communication with the battery compartment, one end of the negative connecting plate is detachably mounted in the mounting slot, another end of the negative connecting plate is moveably in contact with a negative terminal of the rechargeable battery, the positive pogo pin is mounted in the mounting hole communicating with the battery compartment and is moveably in contact with a positive terminal of the rechargeable battery, and the negative pogo pin is mounted in the mounting hole communicating with the mounting slot and is electrically connected to the negative connecting plate.

2. The behind-the-ear hearing aid as claimed in claim 1, wherein the negative connecting plate is an elastic plate, the negative connecting plate is provided with a bent portion, and the bent portion of the negative connecting plate is movably engaged in the mounting slot.

3. The behind-the-ear hearing aid as claimed in claim 1, wherein the battery holder is provided with a cover plate, an outer end of the accommodating chamber is provided with a recessed platform, the cover plate is fitted in the recessed platform; one side of the recessed platform is provided with a recess, the cover plate is provided with a protrusion extending into the recess, and a gap is defined between the protrusion and the recess.

4. The behind-the-ear hearing aid as claimed in claim 1, wherein the battery assembly further includes a first magnetic member, the behind-the-ear hearing aid further includes a charging device provided with a second magnetic member; the first magnetic member is fixedly mounted on the battery holder, the second magnetic member is fixedly mounted on the charging device, and the first magnetic member is magnetically coupled to the second magnetic member.

5. The behind-the-ear hearing aid as claimed in claim 1, wherein the case includes an upper case and a lower case, and the upper case is detachably mounted to the lower case.

6. The behind-the-ear hearing aid as claimed in claim 5, further comprising a pin, the apparatus including a lining member, the upper case, the lower case and the lining member being provided with a first pin hole, a second pin hole and a third pin hole respectively, the pin being inserted into the first pin hole, the second pin hole and the third pin hole for connecting the upper case, the lower case and the lining member.

7. The behind-the-ear hearing aid as claimed in claim 6, wherein the battery holder is provided with a fourth pin hole, the pin is further inserted into the fourth pin hole for connecting the upper case, the lower case, the lining member and the battery holder.

8. The behind-the-ear hearing aid as claimed in claim 7, wherein the upper case is provided with a positioning block, the lower case is provided with a positioning notch, and the positioning block is fitted in the positioning notch.

* * * * *